US005908034A

United States Patent [19]

Adedeji

[11] Patent Number: 5,908,034

[45] Date of Patent: Jun. 1, 1999

[54] METHOD FOR MAKING A BAND CAST RECONSTITUTED TOBACCO SHEET USING STEAM EXPLODED TOBACCO

[75] Inventor: Jide Adedeji, Macon, Ga.

[73] Assignee: Brown & Williamson Tobacco Corporation, Louisville, Ky.

[21] Appl. No.: 08/986,741

[22] Filed: Dec. 8, 1997

[51] Int. Cl.[6] ..... A24B 3/14; A24B 15/12

[52] U.S. Cl. ..... 131/374; 131/297; 131/298; 131/305; 131/311; 131/353; 131/356; 131/357; 131/370; 131/372

[58] Field of Search ..... 131/297, 298, 131/305, 311, 353, 356, 357, 370, 372, 374

[56] References Cited

U.S. PATENT DOCUMENTS

| | | | |
|---|---|---|---|
| 3,077,890 | 2/1963 | Doyle et al. | 131/374 |
| 3,223,090 | 12/1965 | Strubel et al. . | |
| 3,398,754 | 8/1968 | Tughan | 131/374 |
| 3,575,178 | 4/1971 | Stewart | 131/140 |
| 3,753,440 | 8/1973 | Ashburn | 131/140 |
| 4,094,323 | 6/1978 | Frazier et al. . | |
| 4,148,325 | 4/1979 | Solomon et al. . | |
| 4,211,243 | 7/1980 | Ohno et al. | 131/140 |
| 4,235,249 | 11/1980 | Psaras et al. . | |
| 4,244,381 | 1/1981 | Lendvay . | |
| 4,270,552 | 6/1981 | Jenkins et al. . | |
| 4,582,070 | 4/1986 | Jewell . | |
| 4,730,627 | 3/1988 | Burcham, Jr. et al. . | |
| 4,766,912 | 8/1988 | Hackman et al. | 131/296 |
| 5,095,922 | 3/1992 | Johnson et al. . | |
| 5,143,097 | 9/1992 | Sohn et al. | 131/372 |
| 5,325,877 | 7/1994 | Young et al. | 131/370 |
| 5,377,698 | 1/1995 | Litzinger et al. . | |
| 5,765,570 | 6/1998 | Litzinger et al. | 131/370 |

FOREIGN PATENT DOCUMENTS

| | | | |
|---|---|---|---|
| 434333 | 6/1991 | European Pat. Off. | 131/356 |

OTHER PUBLICATIONS

Lewis, Richard; Hawley's Condensed Chemical Dictionary, p. 68, 1993.

*Primary Examiner*—James Derrington
*Assistant Examiner*—Michael P. Colaianni
*Attorney, Agent, or Firm*—Middleton & Reutlinger; Charles G. Lamb, Esq.

[57] ABSTRACT

A process for improving smoke quality and mechanical properties of a cast reconstituted tobacco sheet is accomplished by adding tobacco materials to an aqueous solution containing ammonium salts and ammonium hydroxide. The resulting first tobacco slurry is then pressurized under steam pressure to at least 60 psi for a period of from about 1 to 5 minutes then depressurized rapidly to ambient. The depressurized tobacco is then formed into a second tobacco slurry. The resulting tobacco residue is then cast into a reconstituted tobacco sheet for further processing into smoking articles.

14 Claims, 3 Drawing Sheets

METHOD FOR MAKING A BAND CAST RECONSTITUTED TOBACCO SHEET USING STEAM EXPLODED TOBACCO

BACKGROUND OF THE INVENTION

This invention relates to a tobacco treating process and more particularly to a process to improve the smoking quality and mechanical properties of a band cast reconstituted tobacco sheet by steam explosion.

In the manufacture of smoking articles, such as cigarettes, pipe tobacco and the like, a substantial portion of the tobacco which has been processed for use in the smoking articles are found to be unsuitable for use because of their physical size or undesirable taste properties. For example, tobacco stems and tobacco fines from manufacturing processes are unsuitable for use in the manufacturing of these smoking articles. Since the stems and fines represent a substantial amount of raw material investment, processes have been developed to further process these stems and fines into products such as reconstituted tobacco sheets which are then useable in relatively large amounts in a mixture with acceptable processed tobacco leaf. In the processing of reconstituted tobacco some of the components within the stems and fines are solubilized and separated from the tobacco solids. These solubilized components are either discarded or a portion thereof is re-introduced at a later stage into the processing of reconstituted tobacco sheets. For example, U.S. Pat. No. 4,744,375 to Denier et al teaches a process for using flavor compounds in tobacco, such as ammonia, to produce a tobacco product which may be utilized in reconstituted tobacco sheets.

SUMMARY OF THE INVENTION

The present invention relates to a method for providing a reconstituted tobacco material wherein the tobacco in the form of stems and fines are dispersed in water. The resulting tobacco slurry is heated within a closed vessel under pressure with saturated steam and maintained for sufficient time to allow swelling or explosion of the tobacco. The vessel is then rapidly depressurized to ambient which results in fiberization of the tobacco particles and chemical depolymerization of some of the constituents within the tobacco. This mechanical action also causes a release and solubilization of pectins, and a slight structural and morphological transformation of the tobacco components. Ammonium hydroxide and an ammonium salt are added to the tobacco slurry either before or after pressurization with steam with the ammonium hydroxide and ammonium salt being added preferably before the steam pressurization. Inverted sugars and humectants have also been found useful in the present invention as well as other selected chemical additives.

It is therefore an object of the present invention to provide a tobacco product for use in reconstituted tobacco resulting in reduced irritation, better tobacco taste, and improved smoke quality.

More particularly, the present invention is directed to a method of making a cast reconstituted tobacco sheet comprising the steps of: adding from 50 to 100 parts by weight of tobacco materials to a vessel containing from 100 to 200 parts by weight of water, from 2 to 20 parts by weight of an ammonium salt, from about 3 to 25 parts by weight of ammonium hydroxide and less than 1 part by weight humectant; bringing the resulting first tobacco slurry mixture to from about 200 to 420° F. and 60 to 400 psi with saturated steam for a period of from about 1 to 15 minutes; reducing the pressure on the first tobacco slurry mixture to ambient in from 0.1 to 1.0 minutes; adding water to form a second tobacco slurry having up to 90 percent by weight water; reducing the particle size of the tobacco; and, forming a cast tobacco sheet product containing from about 9 to 23 percent by weight.

Preferably, in the present invention the ammonium salt will be selected from the group consisting of diammonium phosphate, ammonium acetate, ammonium chloride, ammonium phosphate and mixtures thereof. Humectants, such as glycerine and propylene glycol, as well as inverted sugars, such as glucose and fructose may also be used. The preferred temperature to which the first tobacco slurry will be heated will be approximately 335° F. with approximately 100 psi of saturated steam wherein the tobacco will be subjected to the steam pressure and temperature for a time of approximately 3 minutes.

In an alternative embodiment, the chemical additives are added to the first tobacco slurry after the first tobacco slurry has been subjected to saturated steam at from about 200 to 420° F. and 60 to 400 psi for a period of from about 1 to 15 minutes and then reduced in pressure to ambient prior to further processing into a cast sheet of tobacco.

A better understanding of the present invention will be realized from the hereafter processes and the Examples following such description.

DETAILED DESCRIPTION OF THE PREFERRED EMBODIMENTS

Figure 2:
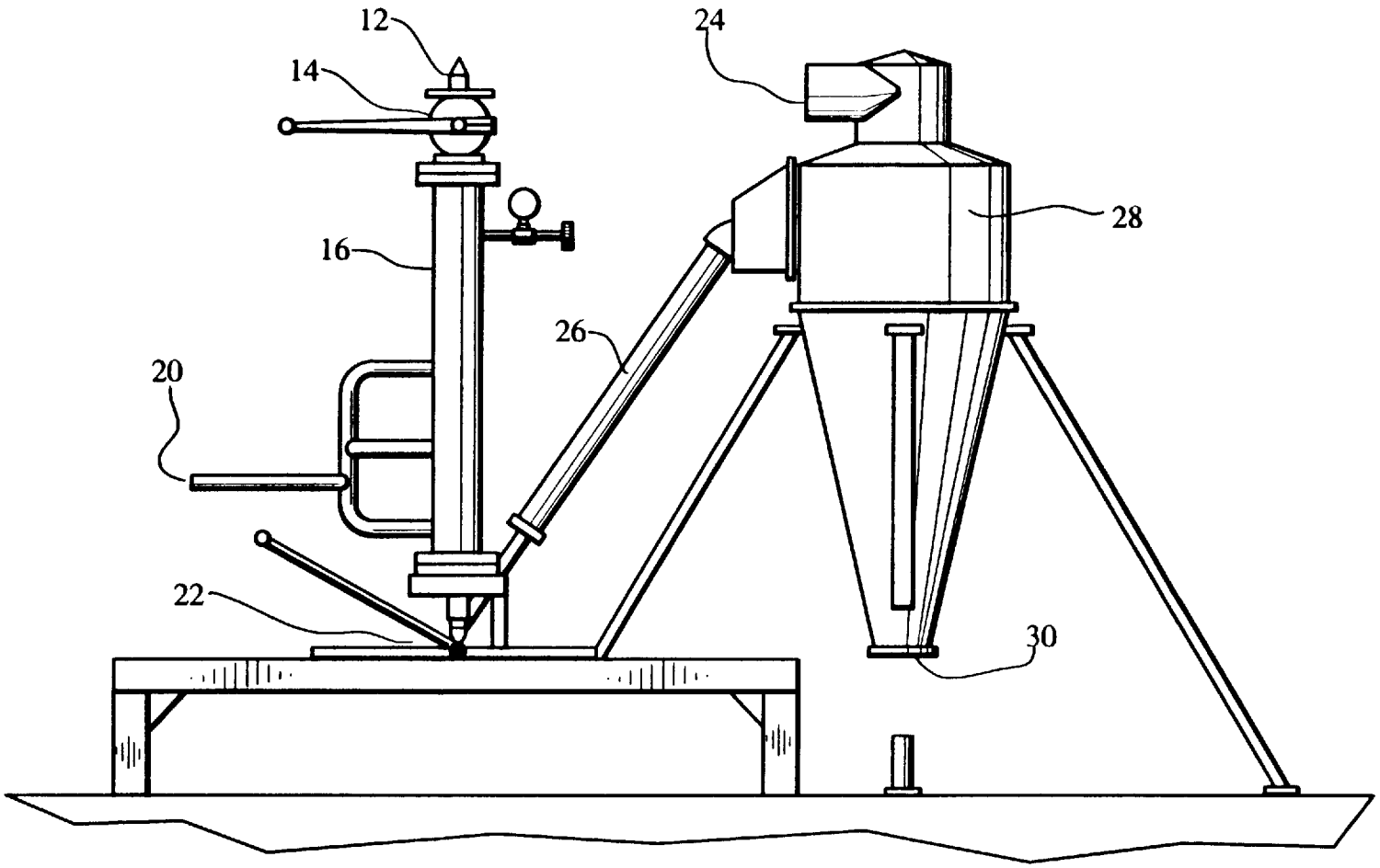
FIG. 2 is an elevational view of one preferred system for steam explosion of tobacco of the present invention.

In a preferred method of carrying out the steam explosion portion of the present invention, as shown in FIG. 2, tobacco materials in the form of flue cured scraps, burley scraps, threshing and fabrication dust, shredded tobacco meal, flue cured stems, burley stems, and the like, are fed into the inlet 12 of a pressure vessel 16 containing water, an ammonium salt, and ammonium hydroxide. A humectant and an inverted sugar may also be added. The total amount of tobacco is in the range of from about 50 to 100 parts by weight to about 100 to 200 parts by weight of water, from about 2 to 20 parts by weight of ammonium salt, from about 3 to 25 parts by weight of ammonium hydroxide, less than 1 part by weight of humectant and less than 1 part by weight of inverted sugar. Preferably, the total chemical additives will be from 5 to 20 parts by weight, the ammonium salt will be from 5 to 10 parts by weight wherein the ammonium hydroxide will be from 10 to 15 parts by weight and the humectant will be less than 1 part by weight. A valve 14 is provided at the inlet 12 to close off the vessel 16 after loading and before steam pressurization.

The ammonium salts which have been found useful in the present invention include diammonium phosphate, ammonium acetate, ammonium chloride, ammonium phosphate, and the like, and mixtures thereof. Preferably, the ammonium salts are from 1 to 5 parts by weight.

Other additives which have been found useful in the present invention include potassium sorbate, citrus pectin, as well as citric and lactic acids. Usually these additives are from 1 to 10 parts by weight and preferably less than 5 parts by weight.

The resulting water/tobacco mix or first tobacco slurry is then subjected to steam through steam inlet 20 wherein steam at from about 60 to 400 psi is introduced until the temperature of the tobacco slurry is increased to from about 60 to 400° F. The resulting temperature is then held for about 1 to 15 minutes. Preferably, the steam will be at approximately 100 psi and about 335° F. with a hold time of about 3 minutes.

The steam pressurized tobacco is then depressurized rapidly in from about 0.1 to 1.0 minutes to ambient. Release valve 22 is then opened and the first tobacco slurry is then transferred by way of conduit 26 into a cyclone separator 28 where steam is exhausted out through outlet 24 and the resulting product is discharged from the bottom discharge 30 for further processing.

Figure 1:
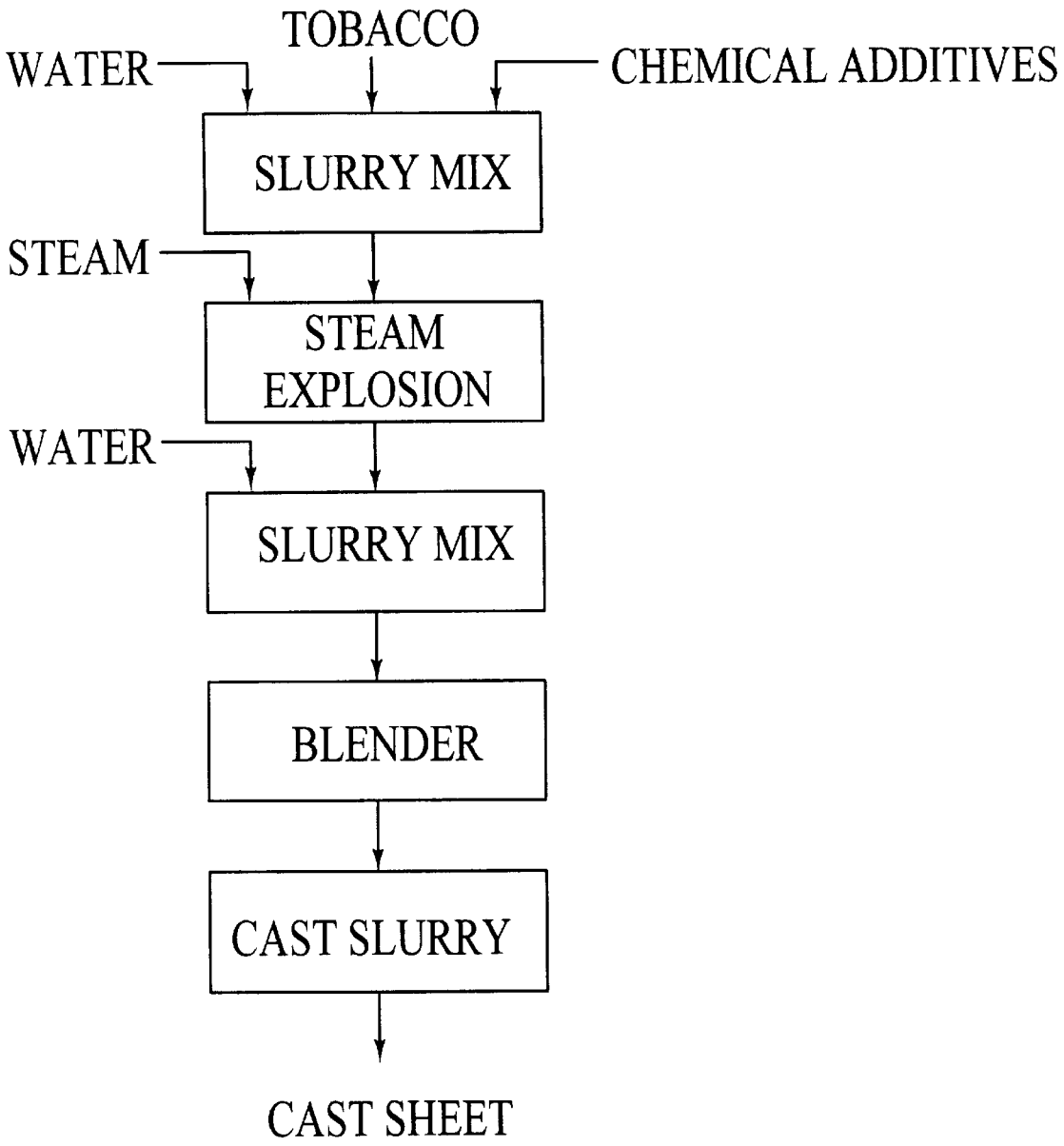
FIG. 1 is a schematic of one preferred process of the present invention.

As shown in FIG. 1, slurry from the steam explosion portion in the process which includes the cyclone separator 28 is transferred to a slurry tank where water is added to produce a second tobacco slurry having up to 90 percent by weight water. In an alternative embodiment, the ammonium hydroxide, ammonium salt, and other chemicals may be added into the second tobacco slurry. The second resulting tobacco slurry is transferred to a pulverizer or disintegrator such as a Rietz-type blender wherein the particle size of the tobacco fibers are further reduced in size. The slurry is then transported to a conventional steam heated drum or box dryer wherein water is removed and simultaneously the tobacco is formed into cast reconstituted tobacco sheets containing from about 10 to 30 parts by weight of water per 100 parts by weight tobacco. The resulting sheet is then prepared for further processing into smoking quality tobacco.

Figure 1A:
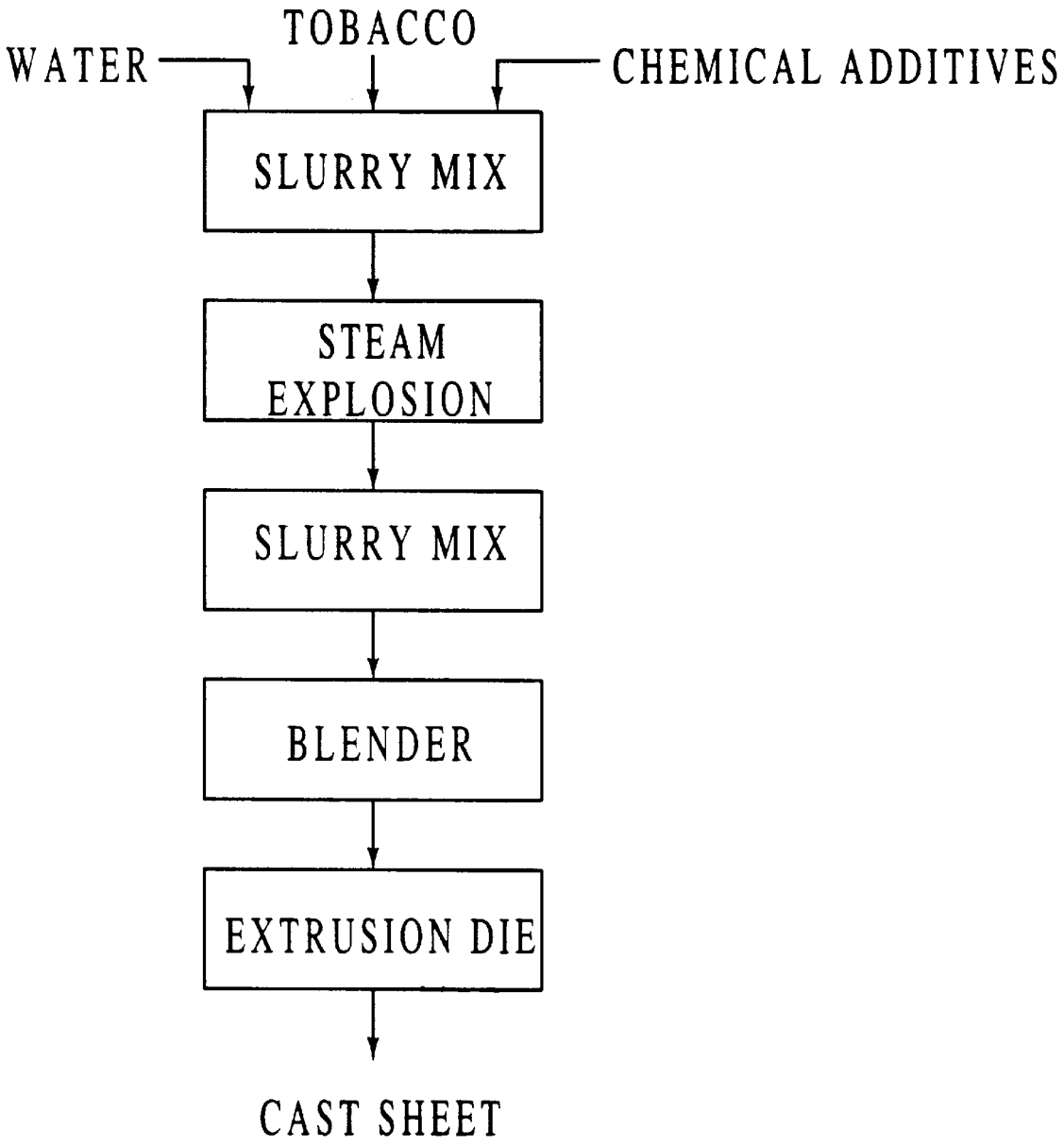
FIG. 1A is a schematic of another process of the present invention.

Alternatively, as shown in FIG. 1A, the tobacco slurry from the steam explosion step is processed without further water addition. This slurry has a higher viscosity and rheology. And, this slurry is generally cast from a pressurized head box or extrusion die onto a steam heated drum dryer to form cast reconstituted tobacco sheets with improved mechanical properties.

EXAMPLES 1–20

For a better understanding of the present invention, the following Examples are incorporated herein to illustrate the present invention with no intention of being unduly limited thereby.

Example 1

A 10.34 pound mixture of tobacco materials including tobacco scraps, threshing and fabrication dust, tobacco meal, flue cured stems, and burley stems were dispersed into 20 pounds of water containing 1.293 pounds of ammonium hydroxide, 0.986 pounds of diammonium phosphate, 0.155 pounds of inverted sugar, 0.0146 pounds of potassium sorbate and 0.516 pounds of glycerin. The tobacco-water-chemical mix was then loaded into a steam vessel wherein 100 psi saturated steam was introduced bringing the temperature within the vessel to 335° F. The 335° temperature was held for three minutes. After the three minutes the pressure vessel was depressurized to ambient in less than 1 minute and simultaneously transferred to a cyclone separator where steam was exhausted and the tobacco product was recovered.

A 1.56 pound sample of the steam pressurized tobacco was added to a vessel containing 4.5 liters of water. This slurry mixture was then heated to 200° F. and held at this temperature for 5 minutes. This mixture was then placed into a Rietz blender, a high shear disintegrator, wherein the mixture was blended to a fine slurry consistency. The slurry was then formed into a film of about 0.025 inches thickness with a gardenier blade on a stainless steel plate then dried on a steam heated box dryer. The cast sheet material was then incorporated into cigarettes.

Example 2

A reconstituted tobacco sheet was made in the same manner in Example 2 as that in Example 1, except that the slurry mixture was held at 200° F. for 90 minutes. The resulting cast reconstituted sheet material was then incorporated into cigarettes.

Example 3

This example was carried out in the same manner and with the same quantities of materials as that utilized in Example 1, the only change being that the tobacco was subjected to a steam pressure of 67 psi and 300° F. and held at this pressure and temperature for 6 minutes. The resulting cast reconstituted sheet of tobacco was incorporated into cigarettes.

Example 4

A cast reconstituted tobacco sheet was made in the same manner as Example 3 except that the slurry mixture was held at 200° F. for 90 minutes.

Example 5

This example was carried out in the same manner and with the same quantities of materials as that utilized in Example 1, except that tobacco was steam treated at 422 psi and 400° F. for 5 minutes.

Example 6

A cast reconstituted tobacco sheet was made in the same manner as Example 5 except that the slurry mixture was held at 200° F. for 90 minutes.

Example 7

This example was carried out in the same manner and with the same quantities of materials as that utilized in Example 1, except that tobacco was steam treated at 134 psi and 350° F. for 10 minutes.

Example 8

A cast reconstituted tobacco sheet was made in the same manner as Example 7 except that the slurry mixture was held at 200° F. for 90 minutes.

Example 9

This example was carried out in the same manner and with the same quantities of materials as that utilized in Example 1, except that tobacco was steam treated at 100 psi and 335° F. for 3 minutes. Tobacco was also held in contact with the additives for 5–6 hours before steam treatment.

Example 10

A reconstituted tobacco sheet was made in the same manner as Example 9 except that the slurry mixture was held at 200° F. for 90 minutes.

Example 11

A total of 10.34 pounds of tobacco materials in the form of flue cured scraps, burley scraps, threshing and fabrication dusts, shredded tobacco meal, small flue cured stems, small burley stems and large burley stems were dispersed in 20 pounds of water. The tobacco-water mix was loaded into a steam pressure vessel and treated with 100 psi saturated steam raising the temperature to 335° F. and held in this condition for 3 minutes.

Subsequently, 1.56 pounds of the steam treated tobacco was added to 4.5 liters of water containing 1.293 pounds of ammonium hydroxide, 0.986 pounds of diammonium phosphate, 0.155 pounds of inverted sugars, 0.0146 pounds potassium sorbate, and 0.516 pounds of glycerin. The mixture was heated to 200° F. and held at this temperature for 5 minutes. The resulting slurry mixture was blended in a high shear blender to a fine slurry consistency. The slurry was then formed into a film of about 0.025 inches in thickness with a gardenier blade on a stainless steel plate. The cast film was then dried in a steam heated box dryer. The resulting cast reconstituted sheet tobacco was incorporated into cigarettes.

Example 12

A reconstituted tobacco sheet was made in the same manner in Example 12 as that in Example 11, except that the slurry mixture was held at 200° F. for 90 minutes. The resulting cast reconstituted sheet material was then incorporated into cigarettes.

Example 13

This example was carried out in the same manner and with the same quantities of materials as that utilized in Example 11, the only change being that the tobacco was subjected to a steam pressure of 67 psi and 300° F. and held at this pressure and temperature for 6 minutes. The resulting cast reconstituted sheet of tobacco was incorporated into cigarettes.

Example 14

A cast reconstituted tobacco sheet was made in the same manner as Example 13 except that the slurry mixture was held at 200° F. for 90 minutes.

Example 15

This example was carried out in the same manner and with the same quantities of materials as that utilized in Example 11, except that tobacco was steam treated at 422 psi and 400° F. for 5 minutes.

Example 16

A cast reconstituted tobacco sheet was made in the same manner as Example 15 except that the slurry mixture was held at 200° F. for 90 minutes.

Example 17

This example was carried out in the same manner and with the same quantities of materials as that utilized in Example 11, except that tobacco was steam treated at 134 psi and 350° F. for 10 minutes.

Example 18

A cast reconstituted tobacco sheet was made in the same manner as Example 17 except that the slurry mixture was held at 200° F. for 90 minutes.

Example 19

This example was carried out in the same manner and with the same quantities of materials as that utilized in Example 11, except that tobacco was steam treated at 100 psi and 335° F. for 3 minutes. Tobacco was also held in contact with the additives for 5–6 hours before steam treatment.

Example 20

A cast reconstituted tobacco sheet was made in the same manner as Example 10 except that the slurry mixture was held at 200° F. for 90 minutes.

Cigarettes prepared with cast reconstituted tobacco from Examples 11–20 were found to have a mild and pleasant taste but those made with reconstituted tobacco from Examples 1–10, which were prepared by adding the ammonium hydroxide and ammonium salt prior to steam pressurization were found to have a milder and more pleasant taste, than those cigarettes using Examples 11–20 reconstituted tobacco.

The foregoing detailed description and Examples are given primarily for clearness of understanding and no unnecessary limitations are to be understood therefrom for modifications will become obvious to those skilled in the art upon reading the disclosure and may be made without departing from the spirit of the invention and scope of the appended claims.

What is claimed is:

1. A method of making a cast reconstituted tobacco sheet comprising the steps of:

a) adding from 50 to 100 parts by weight of tobacco to a vessel containing from 100 to 200 parts by weight of water, from about 5 to 80 parts by weight of chemical additives including from about 2 to 20 parts by weight of an ammonium salt, and from about 3 to 25 parts by weight of ammonium hydroxide said resulting mixture being a first tobacco slurry;

b) bringing the first tobacco slurry to a temperature of from about 200° to 420° F. with 60 to 420 psi of saturated steam and holding said temperature and pressure for a period of from about 1 to 5 minutes;

c) reducing the pressure on the first tobacco slurry to ambient in from 0.1 to 10 minutes;

d) adding water to the first tobacco slurry to form a second tobacco slurry having up to 90 percent by weight water;

e) reducing the particle size of the tobacco in the second tobacco slurry; and, f) removing water from the second tobacco slurry and simultaneously forming a cast tobacco sheet product containing from about 9 to 23 percent by weight of water.

2. The method of claim 1 wherein said ammonium salt is selected from the group consisting of ammonium acetate, ammonium chloride, ammonium phosphate, and mixtures thereof.

3. The method of claim 1 wherein said humectant is selected from the group consisting of glycerine and propylene glycol.

4. The method of claim 1 including the addition of other chemical additives selected from the group consisting of potassium sorbate, urea, citrus pectin, citric acid, lactic acid, and inverted sugars and mixtures thereof.

5. The method of claim 4, said inverted sugars including glucose and fructose.

6. The method of claim 4 said inverted sugars being up to 1 part by weight.

7. The method of claim 1 including reducing the particle size in step e) with a vessel having agitation means therein.

8. The method of claim 1 including removing water with a drum dryer.

9. The method of claim 1, said chemical additives being from 5 to 20 parts by weight.

10. The method of claim 1, said ammonium salt being from 5 to 10 parts by weight.

11. The method of claim 1, said ammonium hydroxide being from 10 to 15 parts by weight.

12. The method of claim 2, said ammonium phosphate being diammonium phosphate.

13. The method of claim 1 including a humectant.

14. The method of claim 13, said humectant being less than 1 part by weight.

* * * * *